US006612300B2

(12) United States Patent
Mukota et al.

(10) Patent No.: US 6,612,300 B2
(45) Date of Patent: Sep. 2, 2003

(54) CUTTING METHOD FOR HARD, BRITTLE MATERIALS

(75) Inventors: Shinji Mukota, Kariya (JP); Satoshi Ishikawa, Anjyo (JP); Satoru Yamaguchi, Anjyo (JP); Hiromi Katou, Kuwana (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/212,715

(22) Filed: Aug. 7, 2002

(65) Prior Publication Data

US 2003/0029432 A1 Feb. 13, 2003

(30) Foreign Application Priority Data

Aug. 10, 2001 (JP) ..... 2001-244676

(51) Int. Cl.[7] ..... B28D 1/02

(52) U.S. Cl. ..... 125/20; 125/12; 125/23.01; 451/177

(58) Field of Search ..... 125/12, 20, 23.01; 451/177

(56) References Cited

U.S. PATENT DOCUMENTS

| | | | | |
|---|---|---|---|---|
| 4,930,486 A | * | 6/1990 | Kuromatsu | 125/11.01 |
| 6,271,102 B1 | * | 8/2001 | Brouillette et al. | 438/462 |
| 6,276,995 B1 | * | 8/2001 | Matsuta et al. | 451/41 |
| 6,439,969 B1 | * | 8/2002 | Koma et al. | 451/41 |

* cited by examiner

*Primary Examiner*—Joseph J. Hail, III
*Assistant Examiner*—Shantese McDonald
(74) *Attorney, Agent, or Firm*—Nixon & Vanderhye P.C.

(57) ABSTRACT

The present invention provides a cutting method for hard, brittle materials that is capable of completely cutting through hard, brittle materials such as ceramic, glass, concrete, stone and single crystal materials without the occurrence of edge chipping and at high speed.

The present invention is characterized by being a method for completely cutting through a hard, brittle material 1 using a disk-shaped rotary grindstone 2, wherein the cross-sectional shape of the outer peripheral edge 20 of rotary grindstone 2 has a V-shaped pointed shape.

5 Claims, 7 Drawing Sheets

CUTTING METHOD FOR HARD, BRITTLE MATERIALS

BACKGROUND OF THE INVENTION

1. Field of the Invention

The present invention relates to a cutting method for hard, brittle materials such as ceramic, glass, concrete, stone and single crystal materials.

2. Description of the Related Art

In the past, a rotary grindstone having a rounded or rectangular edge was used for cutting completely through hard, brittle materials such as ceramic, glass, concrete, stone and Si and other single crystal materials.

For example, although a ceramic honeycomb structural body used as a catalyst support of an automobile exhaust gas purification apparatus is composed of a ceramic material such as cordierite, its manufacturing process consists mainly of forming a dried ceramic body by drying a honeycomb compact obtained by extrusion molding, cutting this to a desired length using the above rotary grindstone and finally baking. In order to increase the production efficiency of the above ceramic honeycomb structural body, it is necessary to increase the cutting speed when cutting the above dried ceramic body with a rotary grindstone.

However, as the above dried ceramic body is hard and brittle, and is chipped extremely easily, when it is cut at a high speed using a rotary grindstone having a rounded or rectangular edge, edge chipping occurs in the cut ends of the dried ceramic body being cut. Consequently, a problem arises in which the above hard, brittle material cannot be cut at high speed.

This problem is not limited to the above dried ceramic body, but also occurs similarly in the case of completely cutting through post-baking ceramics, glass, concrete, stone, single crystal materials such as Si and other hard, brittle materials, using a rotary grindstone.

SUMMARY OF THE INVENTION

One aspect of the present invention relates to a cutting method for hard, brittle materials that is capable of completely cutting through hard, brittle materials such as ceramic, glass, concrete, stone and single crystal materials without the occurrence of edge chipping and at high speed.

Another aspect of the invention relates to method for completely cutting through hard, brittle materials using a disk-shaped rotary grindstone; wherein the cross-sectional shape of the outer peripheral edge of said rotary grindstone has a roughly V-shaped pointed shape.

the cross-sectional shape of the outer peripheral edge of said rotary grindstone has a roughly V-shaped pointed shape.

In the present invention, the above rotary grindstone has a pointed shape roughly in the shape of the letter V as described above. Consequently, concentrated stress, which is generated during cutting of hard, brittle materials with a rotary grindstone, and which is applied to the cut material from the corners of the rotary grindstone and can cause the occurrence of edge chipping, can be reduced. Consequently, even in the case of cutting the above hard, brittle material at higher speeds than in the prior art, concentrated stress from the corners of the rotary grindstone that is applied to the cut material can be suppressed to below the rupture strength of the cut material. For this reason, the occurrence of edge chipping in hard, brittle materials can also be prevented when the rotary grindstone is passed through the cut material.

In this manner, the present invention is able to provide a cutting method for hard, brittle materials that is capable of completely cutting through hard, brittle materials such as ceramics, glass, concrete, stone and single crystal materials without the occurrence of edge chipping and at high speed.

Another aspect of the present invention relates to a method for completely cutting through hard, brittle materials using a disk-shaped rotary grindstone; wherein said rotary grindstone has a tapered portion on its outer peripheral edge that is inclined from a flat portion having a plane in parallel with the radial direction, and the angle of inclination of said tapered portion is 25° or less.

The above rotary grindstone has a tapered portion in its outer peripheral edge that is inclined from a flat portion having a plane in parallel with the radial direction, and the angle of inclination of the above tapered portion is 25° or less.

Consequently, the present invention is able to reduce the concentrated stress, when cutting hard, brittle materials with the above rotary grindstone, which is applied to the cut material from the corners of the grindstone at the boundary between the above flat portion and the above tapered portion. Consequently, as the concentrated stress that is applied to the cut material can be suppressed to below the rupture strength of the cut material even in the case of cutting the above hard, brittle materials at higher speeds than in the prior art, the occurrence of edge chipping in the hard, brittle materials can be prevented when the rotary grindstone passes through the cut material.

Thus, according to the present invention, a cutting method for hard, brittle materials is obtained that is capable of completely cutting through hard, brittle materials such as ceramic, glass, concrete, stone and single crystal materials without the occurrence of edge chipping in said hard, brittle materials and at high speed.

DETAILED DESCRIPTION OF THE PREFERRED EMBODIMENTS

Figure 1:
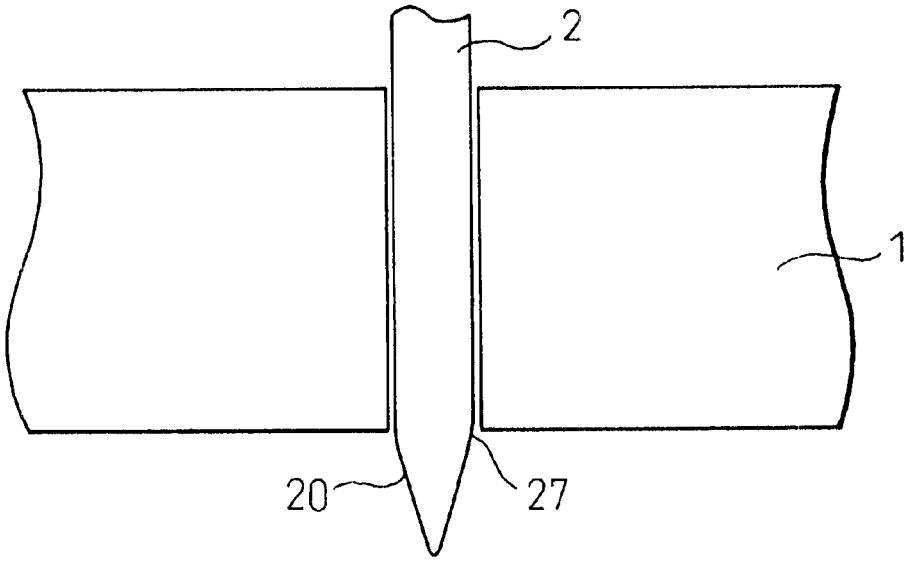
FIG. 1 is a cross-sectional view showing the cutting method for hard, brittle materials in a first exemplary embodiment.

In one aspect of the invention, the above pointed, roughly V-shape is not merely a simple V-shape, but also is a concept that includes a shape that roughly has the image of a V-shape overall even though it is somewhat distorted from a true V-shape as is indicated in the following exemplary embodiments.

In addition, examples of the above hard, brittle materials that can be used include ceramic, glass, concrete, stone and Si and other single crystal materials. All of these have hard, brittle properties, and cutting can be realized at higher speeds than the prior art by using the above rotary grindstone having a pointed shape.

In addition, the angle formed by the above pointed shape is preferably 50° or less. In the case the angle formed by the pointed shape exceeds 50°, the effect of decreasing the stress applied to the cut material during cutting decreases, resulting in a corresponding decrease in the effect of suppressing the occurrence of edge chipping. For this reason, there is the risk of being unable to obtain a sufficiently high cutting speed.

In addition, although the rotary grindstone may be one which is formed by fixing abrasive particles, one composed of abrasive particles arranged on a metal substrate and on the outer peripheral edge of said substrate, and for which the cross-sectional shape of the outer peripheral edge of the above substrate has a pointed shape roughly in the shape of the letter V, is preferable.

In this case, a highly tenacious rotary grindstone can be obtained due to the presence of the above metal substrate.

In addition, the above pointed shape of the above substrate preferably has a curved shape having a radius of curvature of 0.8 mm or more for its outermost edge.

In this case, the attachment of the above abrasive particles to the above outermost edge can be carried out in a stable manner, and the abrasive particles can be inhibited from falling off. On the other hand, in the case the radius of curvature of the above outermost edge is less than 0.8 mm, since an adequate contact surface area cannot be obtained between the abrasive particles and substrate, it is difficult to attach the abrasive particles in a stable manner.

In addition, the above hard, brittle material is preferably a dried ceramic body that has been dried following the formation of a ceramic material.

The above dried ceramic body has the property of being extremely brittle and susceptible to chipping. Consequently, in this case, the effect of using a rotary grindstone having the above pointed shape is demonstrated particularly effectively, and the above dried ceramic body can be cut at high speed without the occurrence of edge chipping.

In addition, the above dried ceramic body is preferably a honeycomb structural body having a housing, partitions arranged in a honeycomb pattern within said housing, and a large number of cells separated by said partitions and continuous between both ends.

As the above partitions of the above honeycomb structural body are chipped extremely easily, the use of a rotary grindstone having the above pointed shape is effective. In addition, as the rupture strength of the partitions decreases considerably when their thickness is 300 $\mu$m or less, the use of the above rotary grindstone having a pointed shape is extremely effective for increasing cutting speed.

Furthermore, an example of the above honeycomb structural body has dimensions within the range of an outer diameter of 76–145 mm, length of 78–155 mm, partition thickness of 0.065–0.3 mm, and cell size of 0.85–1.47 mm. A honeycomb structural body having dimensions within these ranges is extremely brittle in the dried state, and the effect of increasing the cutting speed produced by the above cutting method is large.

Next, in another aspect of the invention, the angle of inclination of the tapered portion is 25° or less as previously mentioned. If this angle of inclination exceeds 25°, it becomes difficult to suppress the concentrated generation of stress, resulting in the problem of a decrease in the effect of preventing edge chipping.

In addition, a material such as ceramic, glass, concrete, stone or a single crystal material can be used for the above hard, brittle material.

In addition, the above hard, brittle material is preferably a dried ceramic body that has been dried following the formation of a ceramic material. In this case as well, the above action and effect are demonstrated effectively, there is no occurrence of edge chipping, and the above dried ceramic body can be cut at high speed.

In addition, the above ceramic dried body is preferably a honeycomb structural body having a housing, partitions arranged in a honeycomb pattern within said housing, and a large number of cells separated by said partitions and continuous with both ends. In this case, the above action and effect are demonstrated particularly effectively.

EMBODIMENT 1

Figure 2:
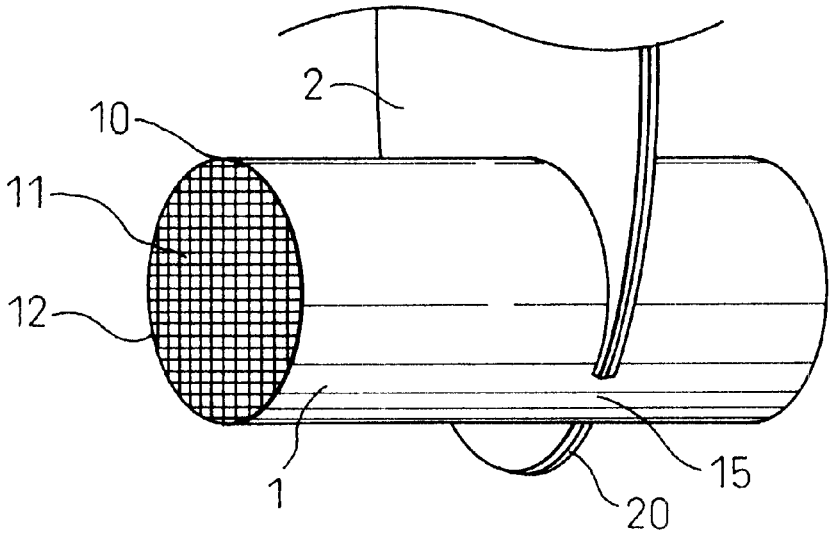
FIG. 2 is a perspective view showing the cutting method for hard, brittle materials in a first exemplary embodiment.
Figure 3A:
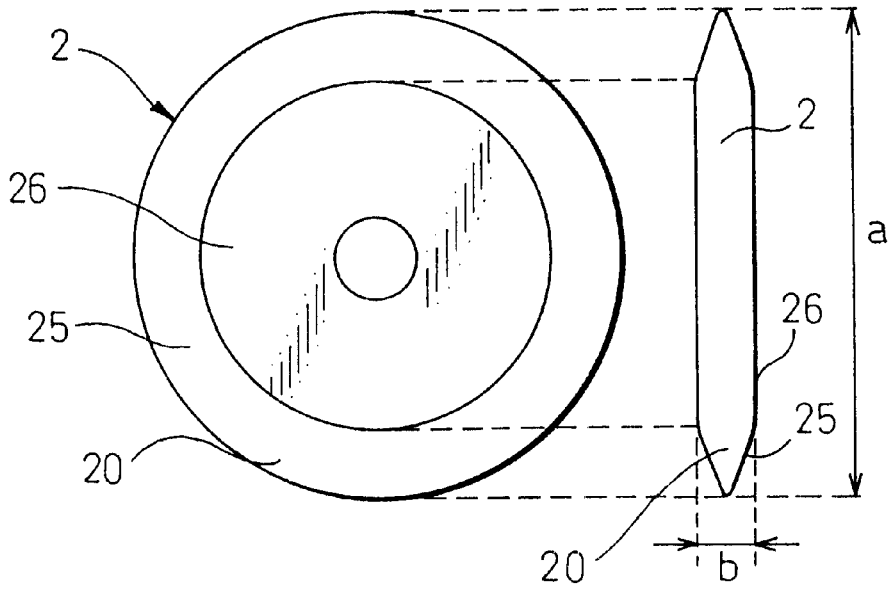
FIG. 3(*a*) is an explanatory drawing showing the rotary grindstone in a first exemplary embodiment, and FIG. 3(*b*) is an explanatory drawing showing the outer peripheral edge of that rotary grindstone.
Figure 3B:
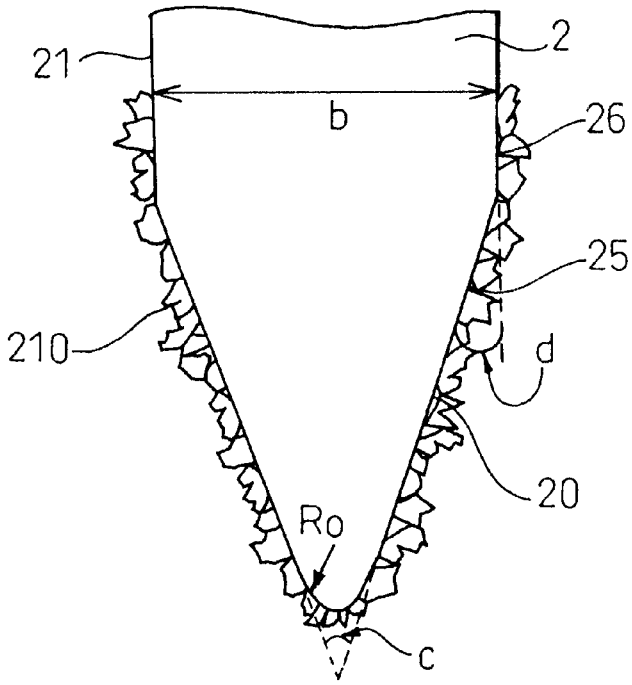

The following provides an explanation of the cutting method for hard, brittle materials in the present invention using FIGS. 1 through 3(*a*)–(*b*).

As shown in FIGS. 1 and 2, the cutting method for hard, brittle materials of the present embodiment is a cutting method for completely cutting through hard, brittle material 1 using a disk-shaped rotary grindstone 2. The cross-sectional shape of the outer peripheral edge 20 of the above rotary grindstone has a pointed shape roughly in the shape of the letter V.

The following provides a detailed explanation of the present embodiment using FIGS. 1 through 3(*a*)–(*b*).

To begin with, as shown in FIGS. 1 and 2, a dried ceramic body in the shape of a honeycomb, obtained in a process for producing a ceramic honeycomb structural body in the form of a catalyst support of an automobile exhaust gas purification apparatus, is prepared for use as hard, brittle material 1.

As shown in FIG. 2, this dried ceramic body is a honeycomb structural body having a housing 10, partitions 11 arranged in a honeycomb pattern within said housing 10, and a large number of cells 12 separated by said partitions 11 and continuous between both ends.

The dimensions of the honeycomb structural body of the present embodiment are such that the honeycomb structural body is extremely thin-walled, with the outer diameter of the housing being 103 mm, the thickness of the partitions being 0.065 mm, the cell size being 0.85 mm, and the housing 10 thickness being 0.3 mm.

As shown in FIGS. 3(*a*) and 3(*b*), the above rotary grindstone 2 is composed of metal substrate 21 and abrasive particles 210 arranged on outer peripheral edge 20 of said substrate 21. The cross-sectional shape of outer peripheral edge 20 of substrate 21 has a pointed shape roughly in the shape of the letter V, and even in the state in which abrasive particles 210 are arranged thereon, the cross-sectional shape of the outer peripheral edge is a pointed shape roughly in the shape of the letter V. Specific dimensions of the substrate consist of outer diameter a=500 mm, width b=3 mm, the angle formed by the above pointed shape, namely tip angle c=30°, and the radius of curvature of the outermost edge R=0.8 mm. Rotary grindstone 2 of the present embodiment is an electrodeposited grindstone in which 60 mesh diamond abrasive particles are electrodeposited on the outer peripheral edge 20 of the above substrate 21.

In addition, as shown in FIG. 3(*b*), the above pointed shape in the present embodiment is, overall, in the shape of the letter V although the above outermost edge has an arc shape, while tip angle c that is the angle formed by tapered portion 25 on both sides is 30° (50° or less) as previously mentioned. In addition, the angle formed with flat portion 26 that is continuous with the top of tapered portion 25 in FIG. 3(*b*), namely angle of inclination d, is 15° (25° or less).

In the present embodiment, as shown in FIGS. 1 and 2, the above rotary grindstone 2 was brought in contact with housing 10 from the outside of honeycomb-shaped dried ceramic body 1, and this was passed through to the opposite side at a cutting speed of 100 mm/s to perform cutting processing of the above hard, brittle material 1.

As a result, in the present embodiment, the cutting process of the above hard, brittle material 1 in the form of a dried ceramic body could be completed without any problem. As shown in FIGS. 1 and 2, occurrence of edge chipping was not observed in observations of the vicinity of the cut edge 15 where the rotary grindstone passed through the hard, brittle material.

The reason why the hard, brittle material was able to be cut smoothly at high speed is considered to be as described below.

Namely, the cross-sectional shape of the outer peripheral edge 20 of the present embodiment is a pointed shape roughly in the shape of the letter V. Consequently, in comparison with the case of the cross-sectional shape of the outer peripheral edge having a rectangular or rounded shape, the stress applied to the cut material when rotary grindstone 2 is moved forward can be reduced. As a result, the occurrence of edge chipping is suppressed. In the present embodiment in particular, both the angle formed by the V in particular, at 30°, and the angle of inclination d of its tapered portion, at 15°, are small. Consequently, the concentrated stress applied to the cut material from corners 27 at the boundary between tapered portion 25 and flat portion 26 can be adequately reduced to a level lower than in the prior art. For this reason, the effect of preventing edge chipping is even further enhanced.

EMBODIMENT 2

In the present embodiment, a comparison was made between a cutting method using a rotary grindstone having a pointed tip in the same manner as Embodiment 1 (Present Invention Method E1), and a cutting method of the prior art using a rotary grindstone having a rounded tip (Conventional Method C1).

Figure 4A:
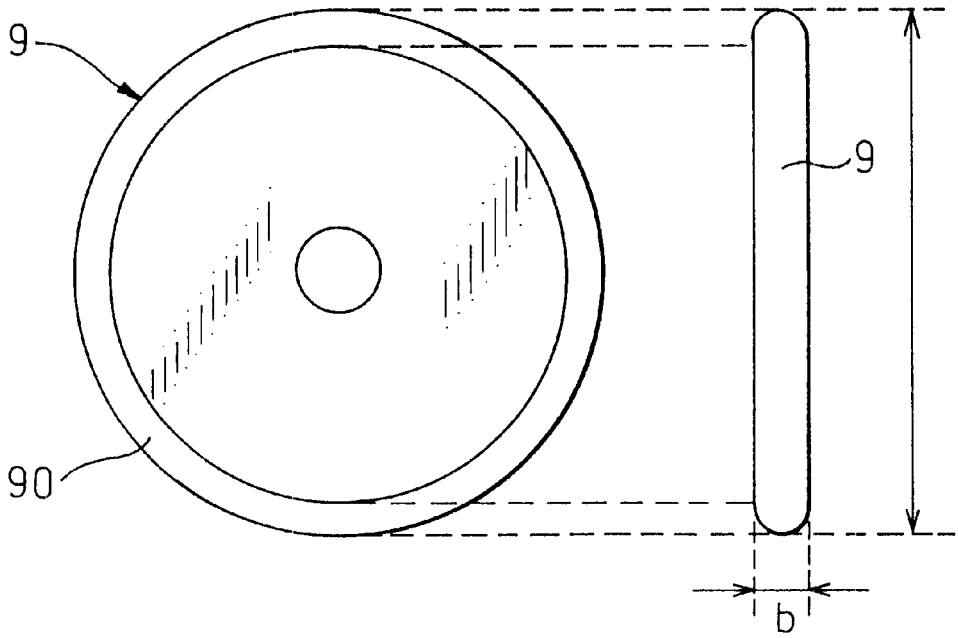
FIG. 4(*a*) is an explanatory drawing showing a rotary grindstone having a rounded edge in a second exemplary embodiment, and FIG. 4(*b*) is an explanatory drawing showing the outer peripheral edge of that rotary grindstone.
Figure 4B:
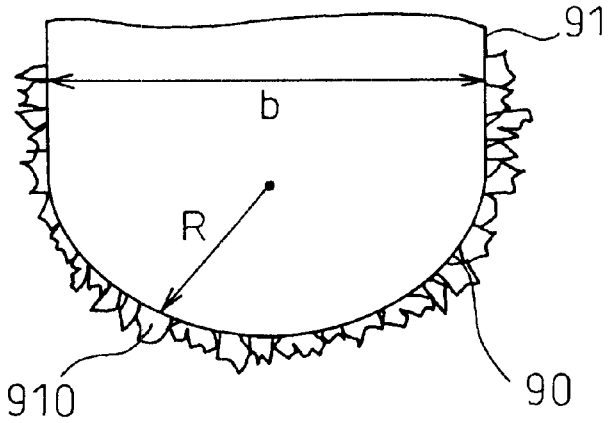

In Conventional Method C1, as shown in FIGS. 4(*a*) and 4(*b*), 60 mesh diamond electrodeposited grindstone 9 having diameter a=500 mm, width b=3 mm and tip radius of curvature R=1.5 mm was prepared for use as a rotary grindstone having a rounded tip. As shown in FIG. 4(*b*), this rotary grindstone is composed of metal substrate 91, and abrasive particles 910 arranged on outer peripheral edge 90 of said substrate 91.

In the present embodiment, a honeycomb-shaped dried ceramic body similar to that of Embodiment 1 was actually cut by changing the respective cutting speeds according to Present Invention Method E1 and Conventional Method C1 followed by measurement of the size of the edge chips. Furthermore, the cutting speed was varied from 10 mm/s to 100 mm/s.

Figure 5:
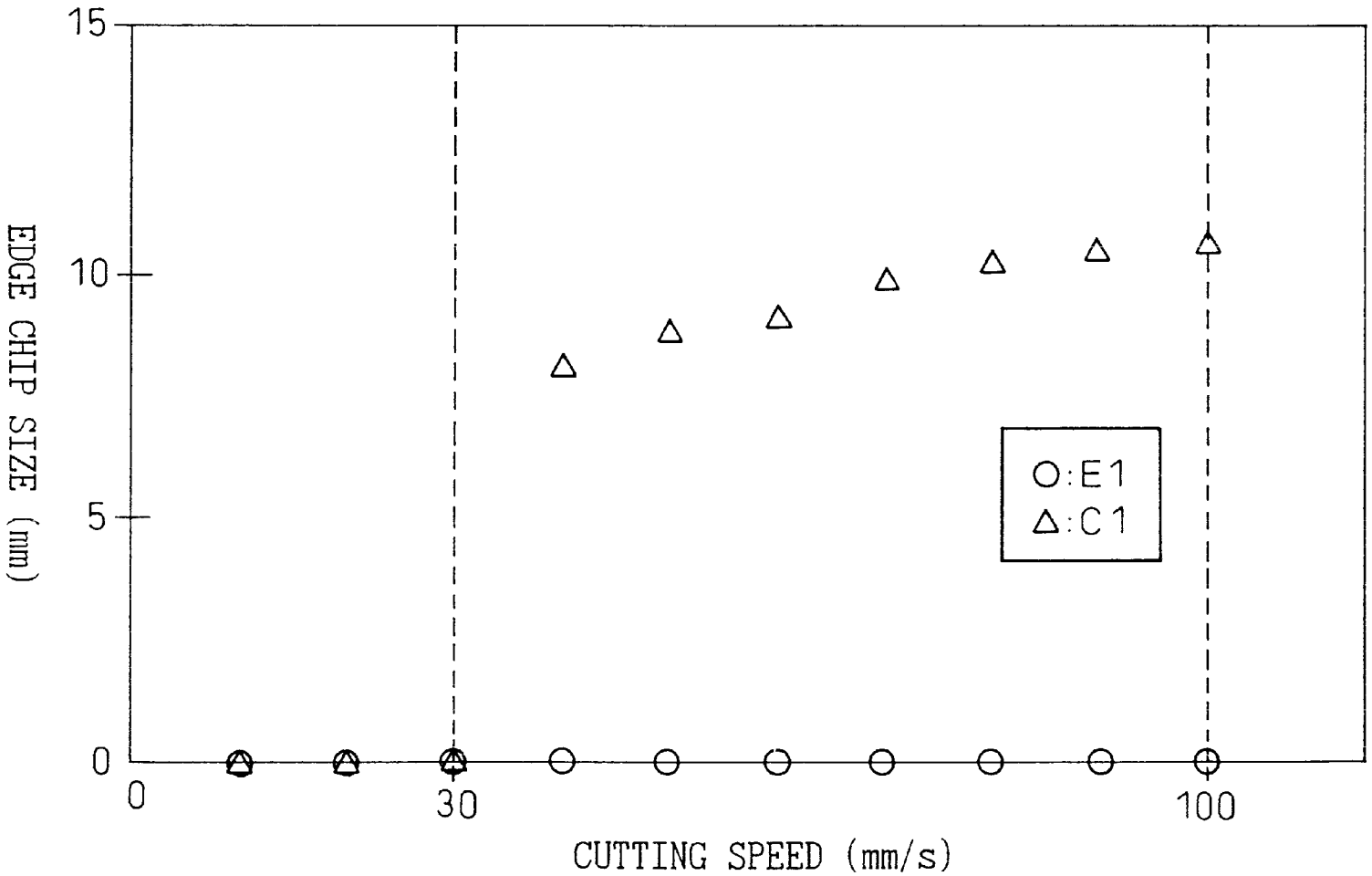
FIG. 5 is an explanatory drawing showing the relationship between cutting speed and the size of edge chips in a second exemplary embodiment.

The measurement results are shown in FIG. 5. In the figure, the horizontal axis represents the cutting speed (mm/s), while the vertical axis represents the size of the edge chips formed (mm).

Figure 6:
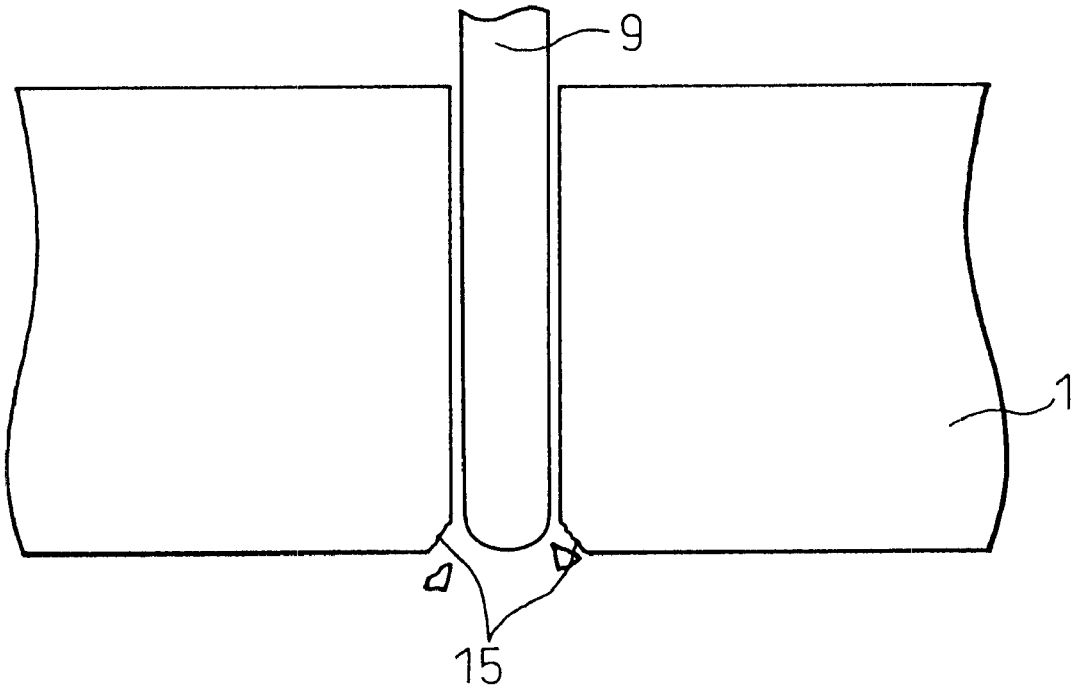
FIG. 6 is an explanatory drawing showing the occurrence of edge chipping in a second exemplary embodiment.

As can be determined from FIG. 5, in Present Invention Method E1, there was no occurrence of edge chipping occurred even if the cutting speed was increased, and even in the case of cutting at a cutting speed of 100 mm/s, no edge chipping was observed whatsoever. In contrast, in Conventional Method C1, when the cutting speed exceeded 30 mm/s, as shown in FIG. 6, edge chipping occurred at grindstone cut edge 15. In addition, the edge chips produced increased in size as the cutting speed increased.

On the basis of the above results, the cutting method for hard, brittle materials of the present invention (Present Invention Method E1) was able to cut through the hard, brittle material without any occurrence of edge chipping whatsoever even when cutting was carried out at a cutting speed roughly three times greater than that of the cutting method of the prior art (Conventional Method C1).

EMBODIMENT 3

In the present embodiment, two variations are shown in which hard, brittle material 1 was cut in the same manner as Embodiment 1 while changing the shape of outer peripheral edge 20 of rotary grindstone 2.

Figure 7A:
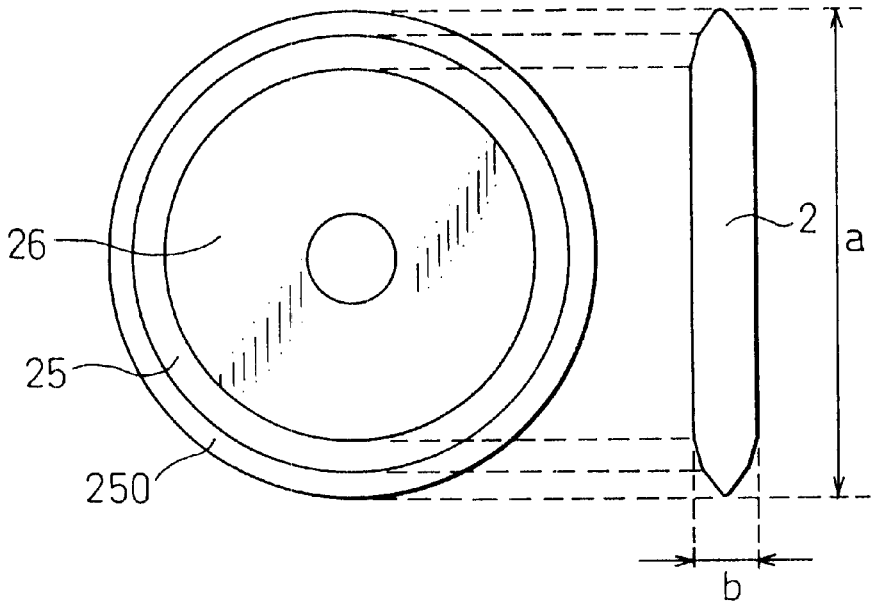
FIG. 7(*a*) is an explanatory drawing showing a rotary grindstone in a third exemplary embodiment, and FIG. 7(*b*) is an explanatory drawing showing the outer peripheral edge of that rotary grindstone.
Figure 7B:
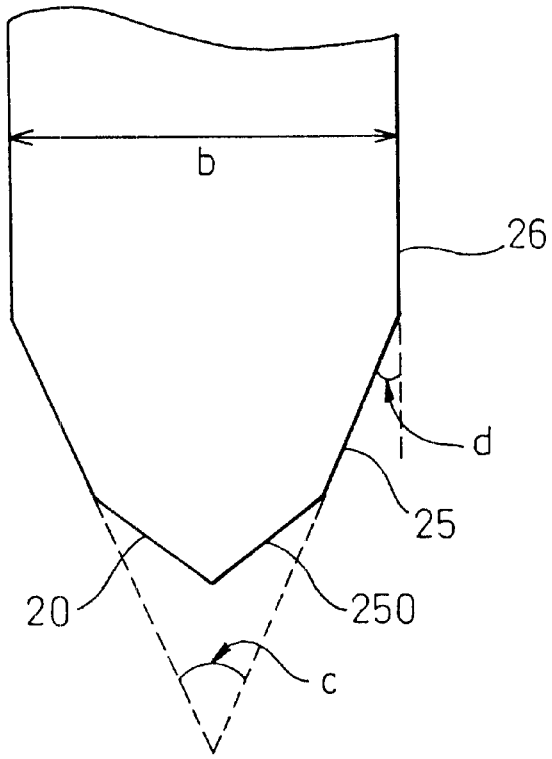

Rotary grindstone 2 of the first variation has tapered portion 25 extending downward from flat portion 26 on outer peripheral edge 20, and inclined portion 250 extending further downward from said tapered portion 25, as shown in FIGS. 7(*a*) and 7(*b*), and the cross-sectional shape of outer peripheral edge 20 has a pointed shape that is roughly in the shape of the letter V overall. The specific dimensions are outer diameter a=500 mm, width b=3 mm and tip angle c=30°.

In addition, as shown in FIG. 7(*b*), although the cross-sectional shape of outer peripheral edge 20 in the above first variation has been distorted from the shape of the letter V, it demonstrates a V shape overall when lines are extended downward from tapered portions 25 on both sides, and tip angle c, which is the angle formed by tapered portions 25 on both sides, is 30° (50° or less). In addition, the angle d formed by tapered portion 25 and flat portion 26 that extends upward from said tapered portion 25 in FIG. 7(*b*) is 15° (25° or less).

Figure 8A:
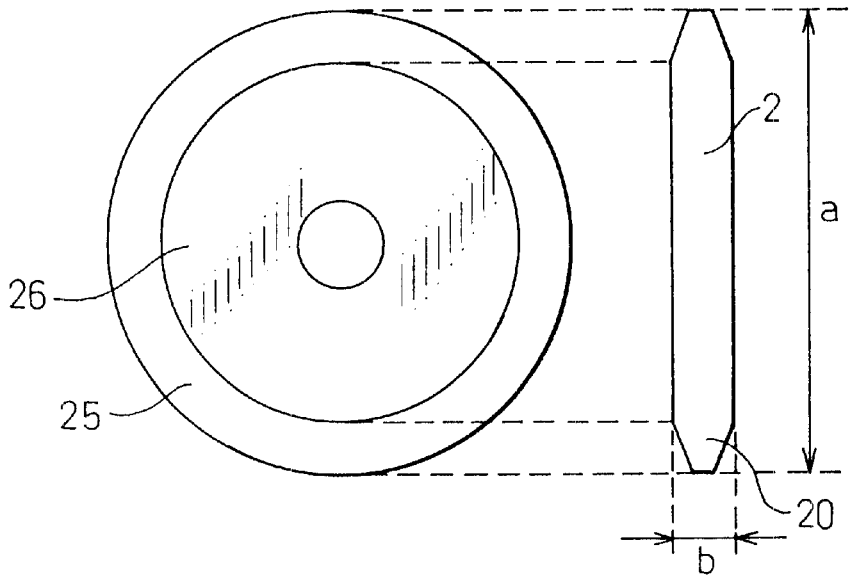
FIG. 8(*a*) is an explanatory drawing showing a rotary grindstone in a third exemplary embodiment, and FIG. 8(*b*) is an explanatory drawing showing the outer peripheral edge of that rotary grindstone.
Figure 8B:
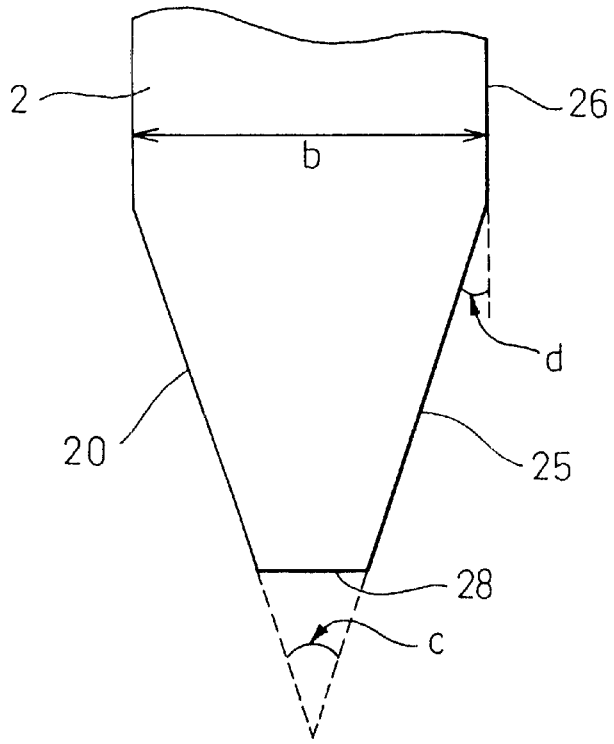

Next, as shown in FIGS. 8(*a*) and 8(*b*), a second variation in the present embodiment has tapered portion 25 extending downward from flat portion 26 on outer peripheral edge 20, and tip 28 extending downward from said tapered portion 25 and parallel to the direction of width of the rotary grindstone, and the cross-sectional shape of outer peripheral edge 20 has a pointed shape roughly in the shape of the letter V overall. The specific dimensions are outer diameter a=500 mm, width b=3 mm and tip angle c=30°.

In addition, as shown in FIG. 8(*b*), although the cross-sectional shape of outer peripheral edge 20 has been distorted from the shape of the letter V in this second variation as well, similar to the first variation, it demonstrates a V shape overall when lines are extended downward from tapered portions 25 on both sides, and tip angle c, which is the angle formed by tapered portions 25 on both sides, is 30° (50° or less). In addition, the angle d formed by tapered portion 25 and flat portion 26 that extends upward from said tapered portion 25 in FIG. 8(*b*) is 15° (25° or less).

In the present embodiment, regardless of the shape of outer peripheral edge 20 of rotary grindstone 2 that was used to cut at high speed in the same manner as Embodiment 1, there was no occurrence of edge chipping of the hard, brittle material.

What is claimed is:

1. A method for completely cutting through at least one hard, brittle material, the method comprising using a disk-shaped rotary grindstone to cut, the cross-sectional shape of the outer peripheral edge of said rotary grindstone having a roughly V-shaped pointed shape;

wherein said hard, brittle material is a dried ceramic body that has been dried following the formation of a ceramic material, and the dried ceramic body is a honeycomb structural body having a housing, partitions arranged in a honeycomb pattern within said housing, and a large number of cells separated by said partitions and continuous between both ends.

2. The cutting method for hard, brittle materials according to claim 1 wherein an angle formed by said pointed shape is 50° or less.

3. The cutting method for hard, brittle materials according to claim 1 wherein said rotary grindstone is composed of a metal substrate and abrasive particles arranged on the outer peripheral edge of said substrate, and the cross-sectional shape of the outer peripheral edge of said substrate has a roughly V-shaped pointed shape.

4. The cutting method for hard, brittle materials according to claim 3 wherein said pointed shape of said substrate has a curved shape having a radius of curvature of 0.8 mm or more on its outermost edge.

5. A method for completely cutting through at least one hard, brittle material, the method comprising using a disk-shaped rotary grindstone to cut, said rotary grindstone having a tapered portion on its outer peripheral edge that is inclined from a flat portion having a plane parallel with the radical direction, and the angle of inclination of said tapered portion is 25° or less;

wherein said hard, brittle material is a dried ceramic body that has been dried following the formation of a ceramic material, and he dried ceramic body is a honeycomb structrical body having a housing, partitions arranged in a honeycomb pattern within said housing, and a large number of cells separated by said partitions and continuous between both ends.

* * * * *